US006419334B1

(12) United States Patent
Akuzawa et al.

(10) Patent No.: US 6,419,334 B1
(45) Date of Patent: Jul. 16, 2002

(54) INK-JET PRINTER

(75) Inventors: Yoshihide Akuzawa, Shizuoka-ken; Sakae Shiida, Numazu; Shinichiro Fujii, Mishima, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/435,284

(22) Filed: Nov. 5, 1999

(30) Foreign Application Priority Data

Nov. 11, 1998 (JP) ..... 10-320822
Jan. 27, 1999 (JP) ..... 11-018423

(51) Int. Cl.[7] ..... B41J 25/308; B41J 23/00
(52) U.S. Cl. ..... 347/8; 347/37; 347/38
(58) Field of Search ..... 347/8, 22, 104, 347/105, 37, 38, 1–7, 14, 23

(56) References Cited

U.S. PATENT DOCUMENTS 6,048,060 A * 4/2000 Narushima et al. ..... 347/104

FOREIGN PATENT DOCUMENTS

JP 5-193226 8/1993 ..... 347/8
JP 10-138520 5/1998 ..... 347/8

* cited by examiner

*Primary Examiner*—John Barlow
*Assistant Examiner*—Charles W. Stewart, Jr.
(74) *Attorney, Agent, or Firm*—Frishauf, Holtz, Goodman, Langer & Chick, P.C.

(57) ABSTRACT

A nozzle unit having a plurality of nozzle heads is vertically moved by an elevating mechanism between a printing position where it prints on a printing surface, and a non-printing position above the printing position and separate from the printing position by a predetermined distance. When the nozzle unit moves to the printing position, it is disengaged from the elevating mechanism to be free from it. The nozzle unit which has moved to the printing position is supported by a head support mechanism to be movable in the main scanning direction.

15 Claims, 11 Drawing Sheets

INK-JET PRINTER

BACKGROUND OF THE INVENTION

The present invention relates to an ink-jet printer which prints by discharging ink from a nozzle head, having a large number of ink-jet nozzles aligned in the printing direction, toward a printing surface.

In a so-called serial ink-jet printer, nozzle heads for different colors mounted with ink cassettes are reciprocally moved over the entire length in the main scanning direction. During this reciprocal movement, the heads print in units of lines (or in units of 1/N lines) on a printing medium such as plain paper or an OHP sheet. After one line is printed, the printing medium is fed by one line. These operations are repeated to print a predetermined number of lines. For example, Jpn. Pat. Appln. KOKAI Publication No. 10-138520 proposed by the present applicant discloses the following ink-jet printer. This ink-jet printer has a printing speed much faster than the serial ink-jet printer, and it can continuously print on a large number of sheets. This ink-jet printer can be greatly down-sized when compared to an electro-photographic laser printer.

According to the above-proposed printer, a printing medium fed from a paper feeder is sent to a rotary member by a convey mechanism at a predetermined timing and is wound on the circumferential surface (printing surface) of the rotary member. The rotary member is rotated about its center axis in the subscanning direction at, e.g., 120 RPM.

This printer has a nozzle unit provided with nozzle heads for cyan C, yellow Y, magenta M, and black B, which extend in the main scanning direction, i.e., the axial direction of the rotary member, and which align themselves in the subscanning direction, i.e., in the rotating direction of the rotary member. Ink is supplied to the nozzle unit from an ink supply mechanism including an ink tank, a supply pump, and the like. Ink of the respective colors are discharged from the nozzle heads toward the printing medium to print a desired image on the printing medium.

While moving this nozzle unit forward with a reciprocating mechanism for a predetermined distance (e.g., for a distance corresponding to the pitches among the ink-jet nozzles) in the main scanning direction, line printing is performed on the rotating rotary member, i.e., on the printing medium. At the same time, column printing is performed in the subscanning direction by utilizing rotation of the rotary member. Namely, line printing and column printing can proceed simultaneously by utilizing high-speed rotation of the rotary member, so that the printing speed can be greatly increased (by, e.g., 20 RPM). When printing on one page is completed, the nozzle unit is moved backward to the original position, and after that it moves forward to print the next page. After printing, the printing medium is separated from the rotary member and discharged by the discharge mechanism.

In this printer, since the nozzle heads of the respective colors can be disposed at positions remote from the ink tanks of the respective colors, they can be made lightweight to largely increase the reciprocating speed in the line direction. As a result, the printing speed is further increased, and the capacities of the ink tanks of the respective colors can be greatly increased, so 500 sheets or more can be continuously printed.

To continuously print on a large number of printing media as described above, maintenance for clogging prevention and the like is preferably performed for the nozzle heads of the respective colors at, e.g., every three hours. In order to enable this maintenance, the nozzle unit is movable with respect to the rotary member horizontally between a printing position where it can print, and a non-printing position remote from the rotary member by a predetermined distance. After the nozzle head is moved to the non-printing position by a head moving mechanism including a motor, a rack, and the like, maintenance for the respective nozzle heads is performed by using a maintenance mechanism interposed between the nozzle head and the rotary member. When the maintenance is ended, the nozzle unit is moved backward to the printing position by the head moving mechanism, and the gap between the distal ends of the respective nozzle heads and the printing surface is maintained to, e.g., about 1 mm.

When the nozzle unit is at the printing position, it is difficult to establish the gap between the nozzle head and the printing surface quickly and precisely. Since the gap is directly related to the printing quality, the moving mechanism for the nozzle unit must be machined and assembled at high precision. This leads to a complicated structure of the entire printer and an increase in cost.

Even when the nozzle unit can be set at the printing position at high precision, or even when the head moving mechanism is locked after the nozzle unit is set, if vibration or the like of the motor is transmitted from the head moving mechanism to the nozzle unit, or the constituent elements of the head moving mechanism including the motor have backlash, it is difficult to reliably and stably maintain the established gap without fluctuation.

BRIEF SUMMARY OF THE INVENTION

The present invention has been made in view of the above circumstances, and has as its object to provide an ink-jet printer having a simple structure, in which the gap between a nozzle head at a printing position and a printing surface can be established quickly and precisely, and the established gap can be maintained stably.

In order to achieve the above object, according to the present invention, there is provided an ink-jet printer comprising:

a medium holding member for holding a printing medium;

a nozzle unit having a plurality of nozzle heads, each of the nozzle heads having a large number of ink-jet nozzles aligned in a main scanning direction;

an elevating mechanism for vertically moving the nozzle unit between a printing position where the nozzle heads oppose a printing surface of the printing medium held by the medium holding member with a predetermined gap, to print on the printing surface, and a non-printing position above the printing position to be separate from the printing position where maintenance for the nozzle heads is performed;

an engaging mechanism for causing the elevating mechanism and the nozzle unit to engage each other to allow the nozzle unit to be vertically moved by the elevating mechanism when the nozzle unit is between the printing position and the non-printing position, and to disengage from each other so as to set the nozzle unit to be free from the elevating mechanism when the nozzle unit is located at the printing position; and a head support mechanism for supporting the nozzle unit which has moved to the printing position.

According to the ink-jet printer having the above arrangement, when maintenance for the nozzle heads of the nozzle unit supported at the non-printing position by the elevating mechanism through the engaging mechanism is ended, the nozzle unit is moved downward by the elevating mechanism from the non-printing position to the lower printing position, and is held at the printing position by the head support mechanism. When held at the printing position, the nozzle unit is free from the elevating mechanism. More specifically, the gap between the nozzle heads located at the printing position, and the printing surface is positionally constrained in the vertical direction by only the head support mechanism. Since the printing position is below the non-printing position, the nozzle unit can be stably supported by the head support mechanism by gravity.

After printing is ended, when the elevating mechanism is moved upward, it engages with the nozzle unit through the engaging mechanism with a corresponding time lag. After that, when the nozzle unit moves upward, it separates from the head support mechanism and is moved to the non-printing position by the elevating mechanism.

According to the above arrangement, the gap between the nozzle heads and the printing surface can be established quickly and precisely, and the established gap can be maintained reliably and stably. At the lower printing position, the nozzle unit is separated from the elevating mechanism. As a result, vibration of the elevating mechanism during printing is prevented from being transmitted to the nozzle unit. Therefore, the elevating mechanism need not be strictly vibration-free, so that the structure is simplified and the cost can be reduced.

According to the present invention, there is also provided an ink-jet printer wherein the head support mechanism has a plurality of stationary supports disposed stationarily with respect to an elevating direction of the nozzle unit, and a plurality of movable supports provided on the nozzle unit and supported on the stationary supports at the printing position.

Furthermore, according to the present invention, the head support mechanism includes a three-point support mechanism having two of the stationary supports, which are provided on one side of the printing surface in the main scanning direction, one of the stationary supports, which is provided on the other side of the printing surface, two of the movable supports, which are provided on one end portion of the nozzle unit in the main scanning direction, and one of the movable supports, which is provided on the other end portion of the nozzle unit, the three-point support mechanism supporting the nozzle unit to be movable in the main scanning direction.

According to the above arrangement, the nozzle unit which has moved downward to the printing position can be stably held by the head support mechanism, and the gap between the nozzle heads and the printing surface can be established precisely and stably. When the three-point support mechanism is employed, it can not only hold the nozzle unit in the elevating direction but also the nozzle heads and the printing surface constant three-dimensionally relative to each other, and the positions of the nozzle unit in the main scanning direction can be held in predetermined postures.

According to the present invention, there is also provided an ink-jet printer comprising:

a medium holding member for holding a printing medium;

a nozzle unit having a plurality of nozzle heads aligned in a subscanning direction, each of the nozzle heads having a large number of ink-jet nozzles aligned in a main scanning direction perpendicular to the subscanning direction;

an elevating mechanism for vertically moving the nozzle unit between a printing position where the nozzle heads oppose a printing surface of the printing medium held by the medium holding member with a predetermined gap to print on the printing surface, and a non-printing position above the printing position to be separate from the printing position, where maintenance of the nozzle heads is performed;

a head support mechanism for supporting the nozzle unit, which has moved to the printing position, to be movable in the main scanning direction; and an elevating guide mechanism which regulates movement of nozzle unit in the main scanning direction and a subscanning direction while the nozzle unit is vertically moved by the elevating mechanism between the non-printing position and the printing position, and which cancels movement regulation in the main scanning direction when the nozzle unit moves to the printing position and is supported by the head support mechanism.

According to the present invention, there is also provided an ink-jet printer comprising:

a medium holding member for holding a printing medium;

a nozzle unit having a plurality of nozzle heads aligned in a subscanning direction, each of the plurality of nozzle heads having a large number of ink-jet nozzles aligned in a main scanning direction perpendicular to the subscanning direction;

an elevating mechanism for vertically moving the nozzle unit between a printing position where the nozzle heads oppose a printing surface of the printing medium held by the medium holding member with a predetermined gap to print on the printing surface with the nozzle heads, and a non-printing position above the printing position to be separate from the printing position, where maintenance of the nozzle heads is performed;

a head support mechanism for supporting the nozzle unit, which has moved to the printing position, to be displaceable in the main scanning direction while regulating displacement of the nozzle unit in the subscanning direction; and an elevating guide mechanism which regulates movement of the nozzle unit in the main scanning direction and the subscanning direction while the nozzle unit is vertically moved by the elevating mechanism between the non-printing position and the printing position, and which cancels movement regulation of the nozzle unit in the main scanning direction and the subscanning direction when the nozzle unit moves to the printing position and is supported by the head support mechanism.

According to the ink-jet printer having the above arrangement, the nozzle unit is vertically driven by the elevating guide mechanism while regulating its positions in the main scanning direction and in the subscanning direction. When the nozzle unit is located at the printing position, position regulation for the nozzle unit in the main scanning direction by the elevating guide mechanism, or position regulation for the nozzle unit in both the main scanning direction and the subscanning direction is released. In this state, the nozzle unit located at the printing position is supported by the head support mechanism to be movable in the main scanning direction. As a result, vibration from the elevating means in the main scanning direction, or both in the main scanning direction and the subscanning direction is not transmitted. When printing by discharging ink from the nozzle heads to the printing surface, precise printing can be performed without any positional errors in the main scanning direction, or both in the main scanning direction and the subscanning direction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 6, and FIGS. 7A to 7D show an ink-jet printer according to an embodiment of the present invention, in which:

FIG. 1 is a sectional view showing the entire portion of the ink-jet printer;

FIG. 2 is a side view showing the drum, the nozzle unit, the three-point support mechanism, and the engaging mechanism of the ink-jet printer;

FIG. 3 is a plan view showing the drum, the nozzle unit, the three-point support mechanism, and the engaging mechanism described above;

FIG. 4 is a side view showing the drum, the nozzle unit, an elevating mechanism, and the engaging mechanism in a state wherein the nozzle unit is located at a printing position and the carrier of the elevating mechanism has moved to a disengaging position;

FIG. 5 is a side view showing the drum, the nozzle unit, the elevating mechanism, and the engaging mechanism in a state wherein the nozzle unit and the carrier are located at a non-printing position;

FIG. 6 is a side view showing the drum, the nozzle unit, the elevating mechanism, and the engaging mechanism in a state wherein the nozzle unit and the carrier are located at the printing position; and FIGS. 7A to 7D are views schematically showing different move positions of the nozzle unit with respect to the drum; and FIGS. 8 to 11 show an ink-jet printer according to the second embodiment of the present invention, in which:

FIG. 8 is a side view showing a drum, a nozzle unit, an elevating mechanism, and an elevating guide mechanism in a state wherein the nozzle unit and a carrier are located at a non-printing position;

FIG. 9 is a side view of the nozzle unit and elevating guide mechanism seen from the direction of arrows IX of FIG. 8;

FIG. 10 is a side view showing the drum, the nozzle unit, the elevating mechanism, and the elevating guide mechanism in a state wherein the nozzle unit is located at the printing position and the carrier of the elevating mechanism has moved to the disengaging position; and FIG. 11 is a side view of the nozzle unit and the elevating guide mechanism seen from the direction of arrows XI of FIG. 10.

DETAILED DESCRIPTION OF THE INVENTION

Figure 1:
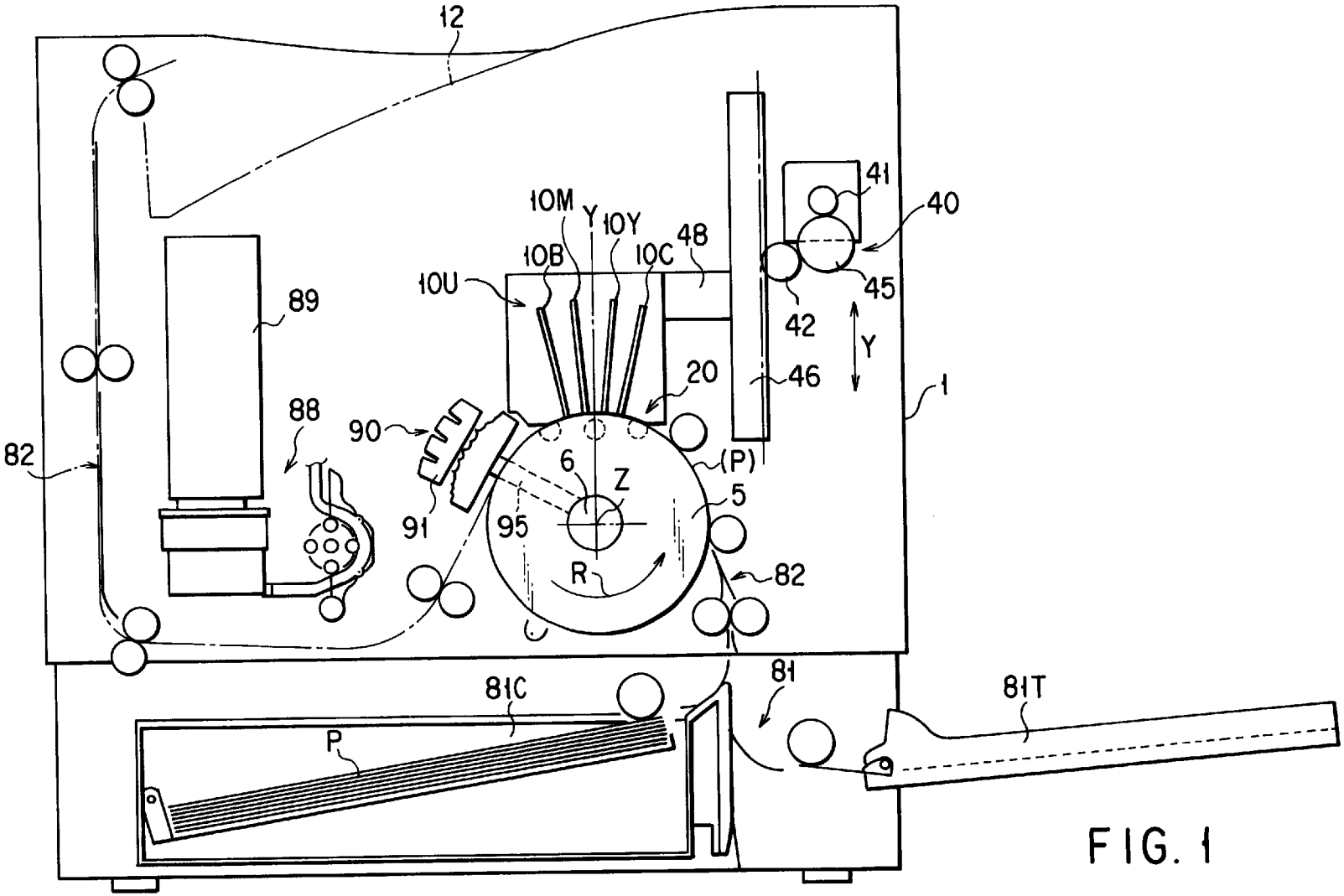

An ink-jet printer according to an embodiment of the present invention will be described in detail with reference to the accompanying drawings.

The overall arrangement of the ink-jet printer will be schematically described. The ink-jet printer has a substantially rectangular housing 1. A rotary member which serves as a printing medium holding member, e.g., a drum 5, is rotatably supported at substantially the center in the housing 1. A nozzle unit 10U having a plurality of, e.g., four nozzle heads 10C, 10Y, 10M, and 10B for four different colors (cyan C, yellow Y, magenta M, and black B), is located above the drum 5. The nozzle unit 10U is vertically movable between a printing position in FIG. 1 and a non-printing position (to be described above) located above the printing position. At the printing position, the nozzle unit 10U prints on a sheet wound around the circumferential surface of the drum 5. At the non-printing position, the nozzle unit 10U performs maintenance of the nozzle heads 10C, 10Y, 10M, and 10B. An elevating mechanism 40 for vertically driving the nozzle unit 10U is located in the housing 1. A three-point support mechanism 20 is provided to support the nozzle unit 10U which has moved to the printing position. While the nozzle unit 10U is supported by the three-point support mechanism 20, it is disengaged from the elevating mechanism 40 to be free from it.

A feeder 81 having a sheet cassette 81C storing sheets P as the printing medium, a manual paper feed tray 81T, and the like is placed under the drum 5. A convey mechanism 82 is provided in the housing 1. The convey mechanism 82 conveys the sheet P sent from the feeder 81 to the drum 5 and conveys the printed sheet P onto a delivery tray 12 on the upper surface of the housing 1.

An ink feed mechanism 88 and a cleaning mechanism 90 are arranged in the housing 1. The ink feed mechanism 88 includes an ink tank 89, a feed pump, and the like to feed ink to the respective nozzle heads 10C, 10Y, 10M, and 10B. The cleaning mechanism 90 serves as a maintenance mechanism for cleaning the nozzle heads 10C, 10Y, 10M, and 10B.

In the ink-jet printer described above, a sheet P fed from the feeder 81 is wound around the circumferential surface of the drum 5 by the convey mechanism 82, and simultaneously the inks are fed from the ink feed mechanism 88 to the nozzle heads 10C, 10Y, 10M, and 10B of the nozzle unit 10U. The nozzle unit 10U is moved by the elevating mechanism 40 to the lower printing position and is positioned and supported there by the three-point support mechanism 20. In this state, ink is discharged from a predetermined nozzle head toward the sheet P to print in color. The printed sheet P is discharged by the convey mechanism 82 onto the delivery tray 12. To clean the nozzle heads 10C, 10Y, 10M, and 10B, the nozzle unit 10U is moved by the elevating mechanism 40 to the non-printing position, and the cleaning mechanism 90 is moved to a position between the nozzle unit 10U and the drum 5 to clean the respective nozzle heads.

Figure 2:
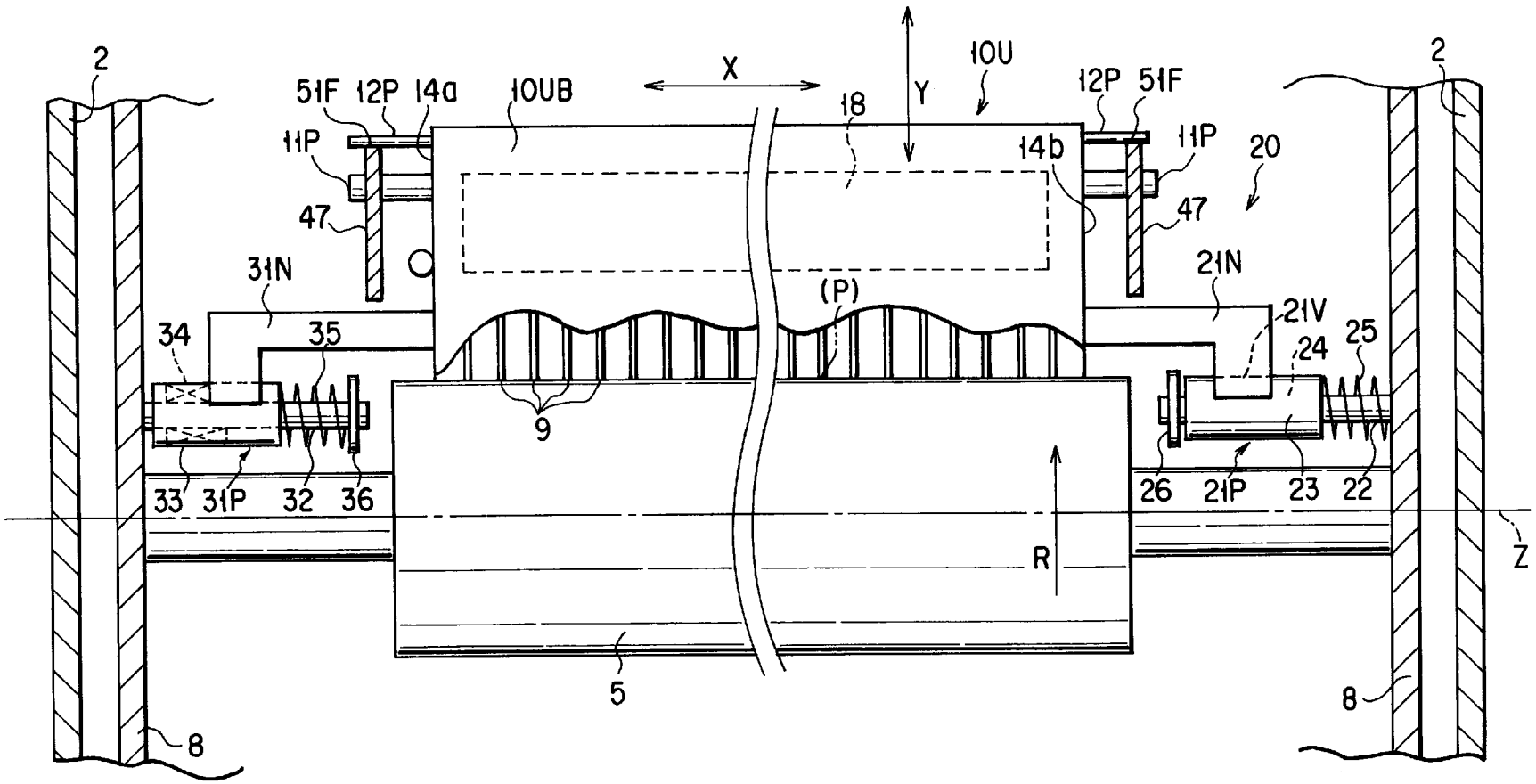

The arrangement of the respective portions will be described in detail. As shown in FIGS. 1 and 2, the housing 1 has a pair of opposing side walls 2, and a pair of brackets 8 are provided inside the side walls 2 to be parallel to each other. A rotating shaft 6 of the drum 5 is rotatably supported by the pair of brackets 8 and extends almost horizontally. The drum 5 is rotated about the central axis in the subscanning direction, i.e., in an R direction, at a high speed of, e.g., 120 RPM. The sheet P conveyed by the convey mechanism 82 is wound around the circumferential surface of the drum 5 by sheet holders (not shown), and is held there. The sheet P then rotates in synchronism with the circumferential surface of the drum 5. The sheet P wound on the circumferential surface of the drum 5 constitutes a printing surface.

As shown in FIGS. 1 to 4, the nozzle unit 10U has a rectangular frame-like unit main body 10UB extending along the axial direction of the drum 5, and the nozzle heads 10C, 10Y, 10M, and 10B of four different colors mounted on the unit main body 10UB. The nozzle heads 10C, 10Y, 10M, and 10B are spaced apart from each other at predetermined gaps in the subscanning direction, i.e., a rotating direction R of the drum 5. Each nozzle head includes a large number of ink-jet nozzles 9 aligned in a main scanning direction, i.e., the axial direction of the drum 5. The nozzles 9 extend radially toward the drum 5, i.e., vertically to the printing surface of the sheet P wound on the circumferential surface of the drum 5.

The distal ends of the ink-jet nozzles 9 of each of the nozzle heads 10C, 10Y, 10M, and 10B are aligned on a circular locus corresponding to the circumferential surface of the drum 5, and are arranged at the printing position shown in FIGS. 1 to 4 with a predetermined gap, i.e., 1 mm, from the printing surface. The nozzle unit 10U is also provided with a driver 18 for driving the ink-jet nozzles 9.

The unit main body 10UB has a pair of side walls 14*a* and 14*b* located at two end sides in the scanning direction X and extending in a direction perpendicular to the rotating shaft of the drum 5. Each of the side walls 14*a* and 14*b* is provided with a pair of engaging pins 11P and 12P projecting in the scanning direction X. The engaging pins 11P and 12P are spaced from each other in the subscanning direction R.

Figure 3:
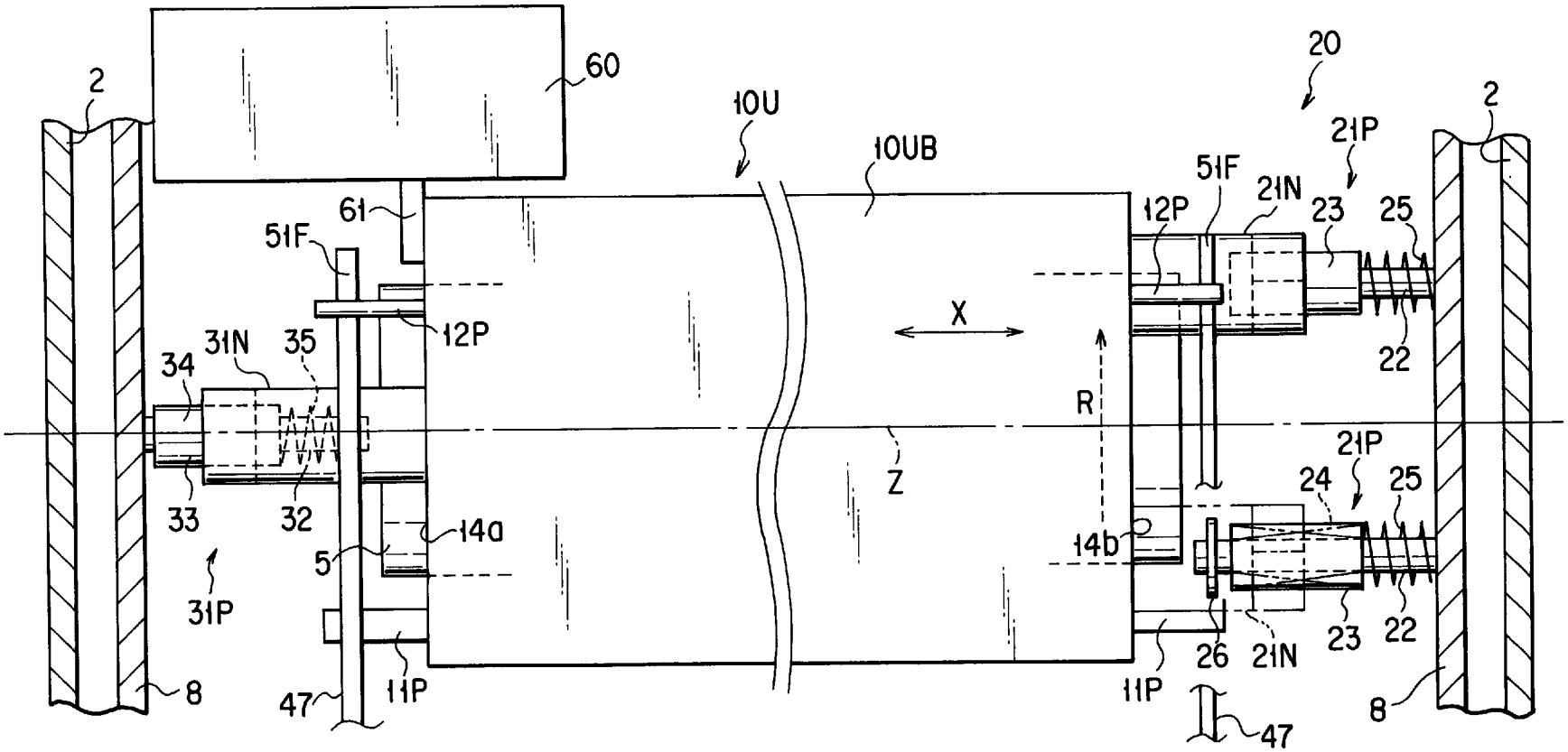
Figure 4:
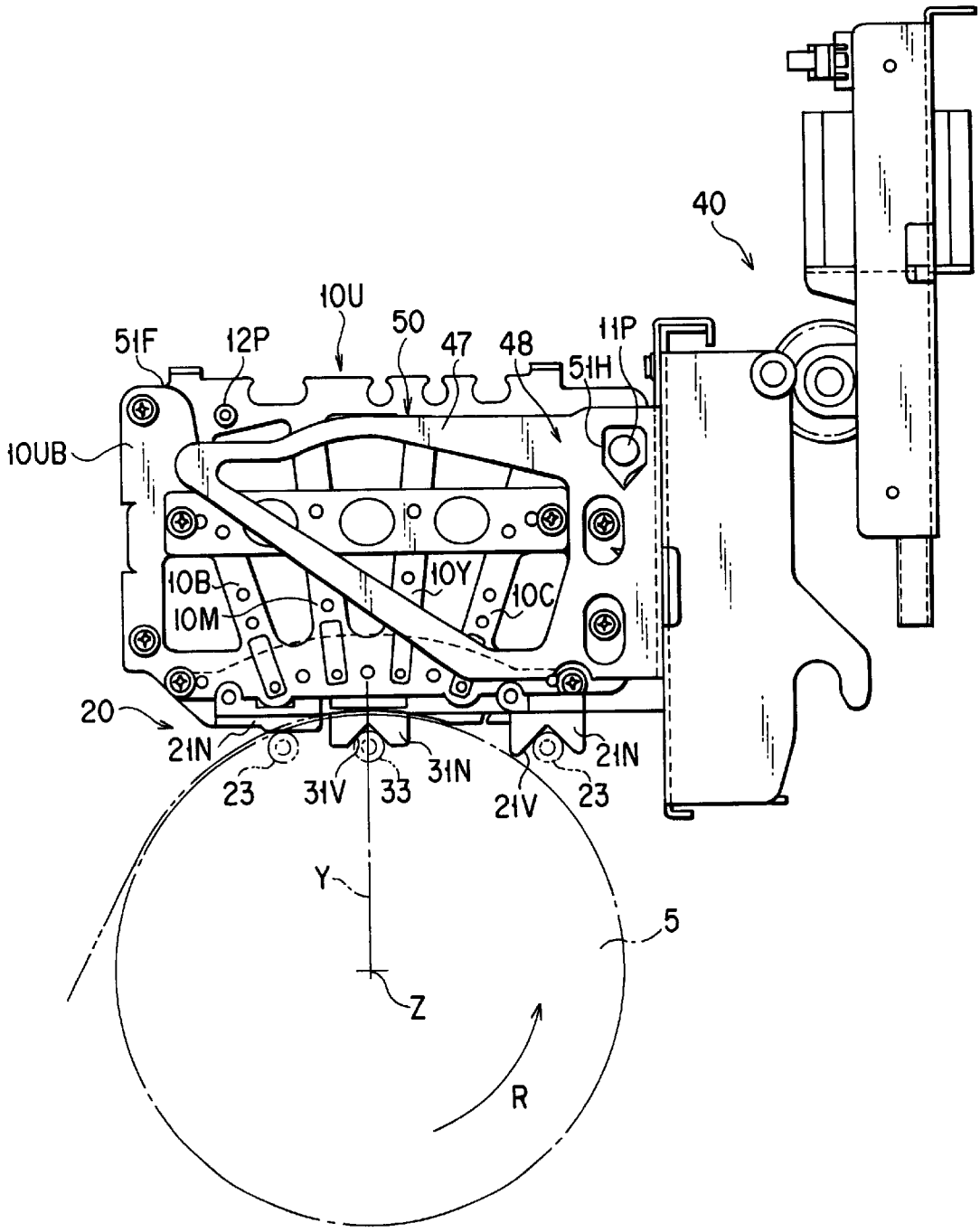
Figure 5:
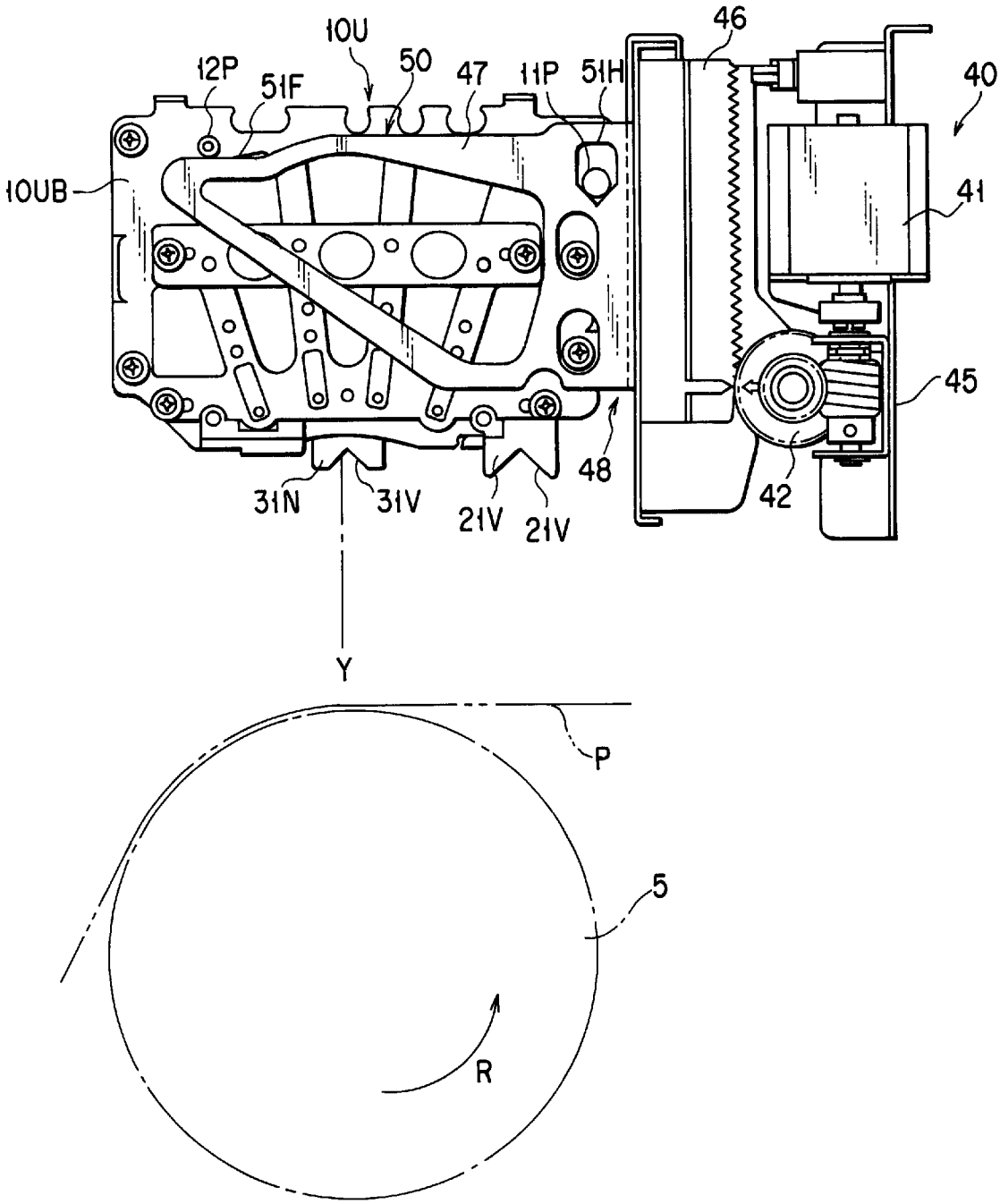

As shown in FIGS. 2 to 4, the three-point support mechanism 20 serving as the head support mechanism has two sets of stationary supports 21P and movable supports 21N on one end side of the drum 5, and one set of a stationary support 31P and a movable support 31N on the other end side of the drum 5. These three sets of stationary and movable supports are symmetric with each other about a central axis Z of the drum 5 in FIG. 3.

More specifically, the stationary supports 21P are provided on the stationary side of the printer, e.g., on one bracket 8 of the housing 1, and the stationary support 31P is provided on the other bracket 8 of the housing 1. These stationary supports 21P and 31P lie within a common horizontal plane parallel to the central axis Z of the drum 5.

Each stationary support 21P has a support shaft 22, a cylindrical member 23, and a spring 25. The support shaft 22 is fixed to one bracket 8 and extends in the main scanning direction X. The cylindrical member 23 is mounted on the support shaft 22 through a bearing 24 to be movable in the X direction. The spring 25 is mounted on the support shaft 22 and serves as a biasing member for biasing the cylindrical member 23 to the left (backward) in FIG. 3. A stopper 26 is fixed to the distal end of each support shaft 22 to regulate the left position of the cylindrical member 23.

Similarly, the stationary support 31P has a support shaft 32, a cylinder 33, and a spring 35. The support shaft 32 is fixed to the other bracket 8 and extends in the main scanning direction X. The cylinder 33 is mounted on the support shaft 32 through a bearing 34 to be movable in the X direction. The spring 35 is mounted on the support shaft 32 and serves as a biasing member for biasing the cylinder 33 to the left (backward) in FIG. 3. A stopper 36 is fixed to the distal end of the support shaft 32 to regulate the left position of the cylinder 23.

The two movable supports 21N are respectively formed of hangers, are fixed to one side wall 14*b* of the unit main body 10UB of the nozzle unit 10U, and extend from the side wall 14*b* in the main scanning direction X. The lower surface of the extending end of one movable support 21N is formed with a V-groove 21V, while the lower surface of the extending end of the other movable support 21N is formed flat. The movable support 31N is formed of a hanger, is fixed to the other side wall 14*a* of the unit main body 10UB, and extends therefrom in the main scanning direction X. The lower surface of the extending end of the movable support 31N is formed with a V-groove 31V. The movable supports 21N and 31N are at the same height, i.e., within the same horizontal plane, and have a positional relationship corresponding to the stationary supports 21P and 31P.

When the nozzle unit 10U moves downward to the printing position, the movable supports 21N descend onto the cylinders 23 of the corresponding stationary supports 21P, and the movable support 31N descends onto the cylinder 33 of the stationary support 31P. The nozzle unit 10U is supported and positioned at the printing position precisely and stably due to gravity; it is regulated by the three-point support mechanism 20 from moving in the elevating direction, i.e., in a Y direction and the subscanning direction R, while it is allowed to move in the main scanning direction X when the cylinders 23 and 33 move. As a result, the three-dimensional positions of the nozzle unit 10U at the printing position and the printing surface relative to each other can be established precisely and can be maintained stably.

Usually, the positions of the cylinder 23 and 33 are regulated by the springs 25 and 35, and the nozzle unit 10U placed on the cylinders 23 and 33 is also regulated at the home position in the X direction.

As shown in FIGS. 2 and 3, a reciprocating mechanism 60 for moving the nozzle unit 10U in the main scanning direction X is provided in the housing 1. The reciprocating mechanism 60 has a drive pin 61 which abuts against the side wall 14*a* of the unit main body 10UB of the nozzle unit 10U located at the printing position. The drive pin 61 is movable in the main scanning direction X.

When the drive pin 61 is driven to apply an external force in the right direction (forward direction) in FIGS. 2 and 3 to the nozzle unit 10U, the nozzle unit 10U moves forward together with the cylinders 23 and 33 against the biasing forces of the springs 25 and 35. When the external force applied by the drive pin 61 is removed, the nozzle unit 10U and the cylinders 23 and 33 move backward by the springs 25 and 35 and return to the home position shown in FIGS. 2 and 3.

The forward moving distance of the nozzle unit 10U is equal to the moving distance of the drive pin 61 in the X direction, and is equivalent to pitches corresponding to the resolving power of printing (e.g., 300 dpi) of the printer. The ink-jet nozzles 9 of each of the nozzle heads 10C, 10Y, 10M, and 10B are disposed in the X direction at pitches twice the pitches corresponding to the resolving power of printing.

As shown in FIG. 1 and FIGS. 4 to 6, the elevating mechanism 40 for vertically moving the nozzle unit 10U has a motor 41, a worm gear mechanism 45, a pinion 42, a rack 46, and the like. The motor 41 is provided to the housing 1. The rack 46 is movable in the vertical direction Y. A carrier 48 is fixed to the rack 46 to be vertically movable together with the rack 46.

The carrier 48 has a pair of support arms 47 spaced apart from each other in the main scanning direction X. The support arms 47 are located on two sides of the nozzle unit 10U and respectively oppose the two side walls 14*a* and 14*b* of the unit main body 10UB at gaps. The support arms 47 support the nozzle unit 10U through a disengageable engaging mechanism 50.

As shown in FIGS. 2 to 6, the engaging mechanism 50 has the pair of engaging pins lip and 12P (described above)

serving as unit-side engaging portions and fixed to the side walls 14*a* and 14*b* of the unit main body 10UB. The engaging mechanism 50 has, as carrier-side engaging portions, engaging holes 51 and support end edges 51F formed in the support arms 47.

Each engaging hole 51H extends in the elevating direction of the carrier 48, i.e., the Y direction, and its lower end forms a V shape. Each support end edge 51F extends almost horizontally and opens upward. The respective engaging pins 11P of the unit main body 10UB loosely inserted through the engaging holes 51H of the corresponding support arms 47, and the respective engaging pins 12P thereof are located above the support end edges 51F of the corresponding support arms 47 and overlap therewith in the Y direction.

When the motor 41 of the elevating mechanism 40 having the above arrangement is driven, the carrier 48 moves, together with the rack 46, vertically in the Y direction between an upper position (shown in FIG. 5) corresponding to the non-printing position and a disengaging position (shown in FIG. 6) much below the printing position. During this vertical movement, the carrier 48 passes through the printing position shown in FIG. 4.

Figure 6:
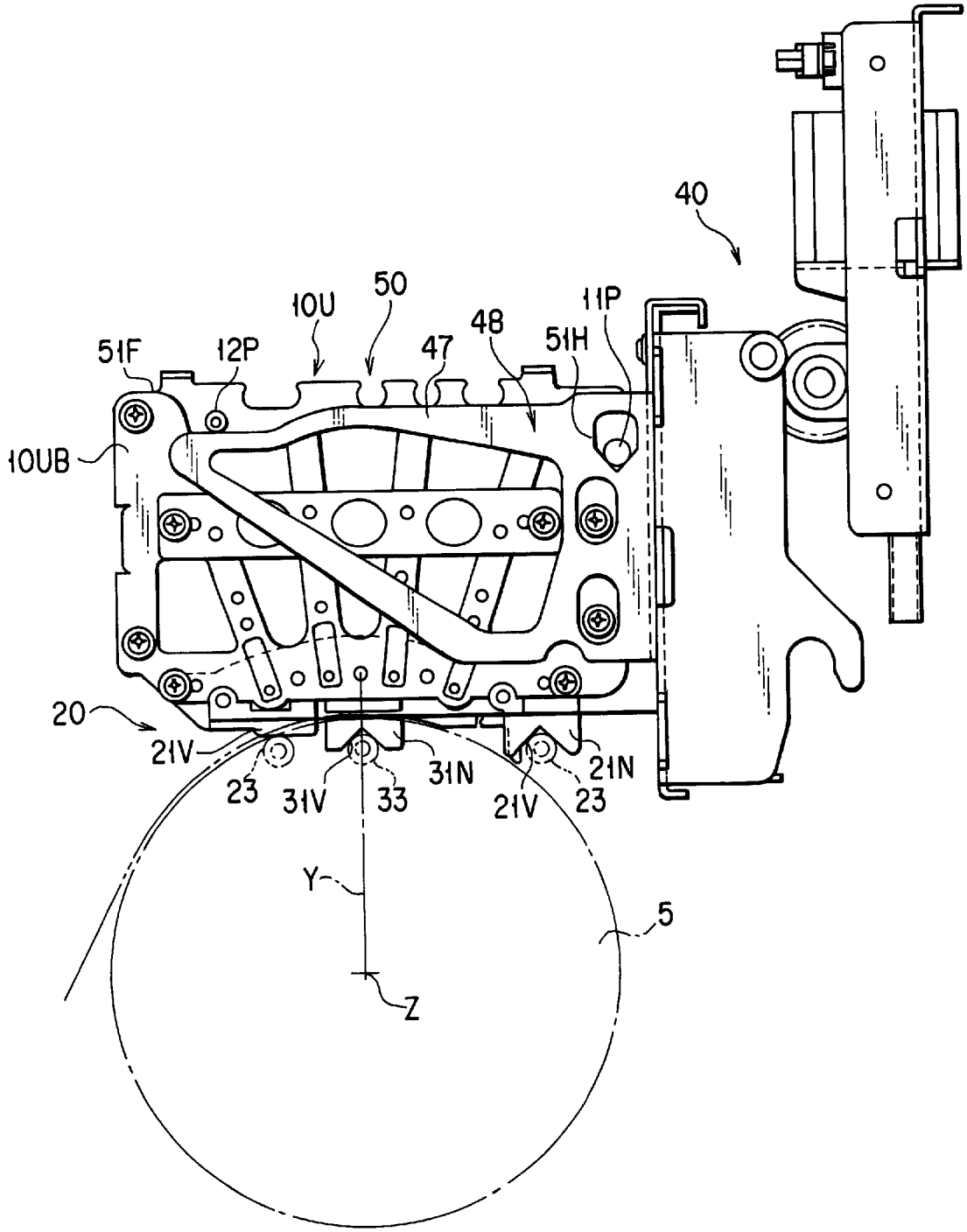

As shown in FIGS. 4 and 6, while the carrier 48 moves between the upper position and the printing position, the engaging pins liP of the nozzle unit 10U abut against the lower ends of the engaging holes 51H of the support arms 47 to be supported by the support arms 47 from below, and the engaging pins 12P thereof abut against the support end edges 51F to be supported by the support arms 47 from below. Accordingly, the nozzle unit 10U is driven by the carrier 48 to move vertically between the upper non-printing position and the lower printing position. While the nozzle unit 10U is supported by the carrier 48, the respective engaging pins 11P of the nozzle unit 10U are regulated by the V-shaped lower ends of the engaging holes 51H of the support arms 47 from moving in the subscanning direction, and the engaging pins 12P thereof are supported by the support end edges 51F to be movable in the subscanning direction.

When the nozzle unit 10U is moved by the carrier 48 from the non-printing position to the printing position, as shown in FIG. 3, it is supported at the printing position by the three-point support mechanism 20. Hence, as shown in FIG. 4, when the carrier 48 moves from the printing position to the disengaging position below it, the lower ends of the engaging holes 51H and the support end edges 51F formed in the respective support arms 47 separate from the corresponding engaging pins 11P and 12P of the nozzle unit 10U. Accordingly, the support arms 47 and nozzle unit 10U disengage from each other. The nozzle unit 10U is free from the carrier 48, and is supported and positioned at the printing position by only the three-point support mechanism 20.

Figure 7A:
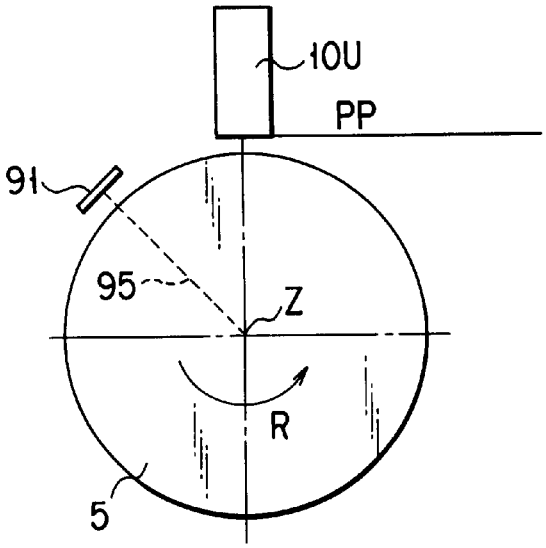
Figure 7B:
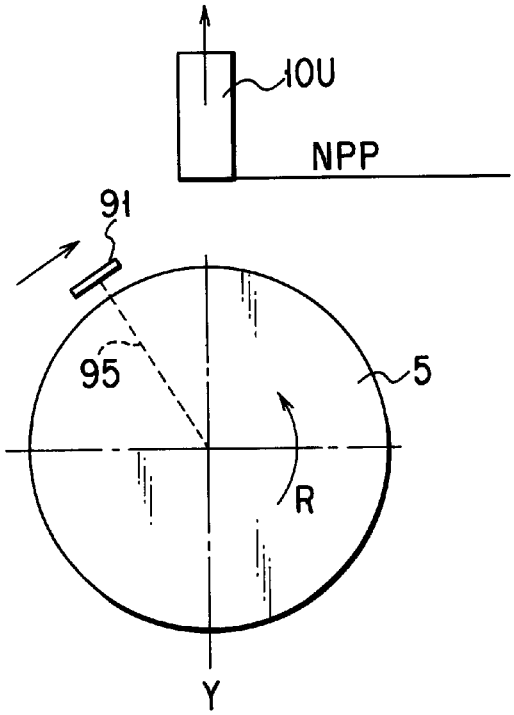

In the above manner, the nozzle un it 10U is driven to move vertically in the Y direction between a printing position PP where it opposes the drum 5 at a predetermined gap as shown in FIG. 7A, and a non-printing position NPP where it is above the printing position to be separate from it by a predetermined distance, as shown in FIG. 7B. The nozzle unit 10U can also be stopped and positioned by the elevating mechanism 40 at a maintenance position MP located between the printing position PP and the non-printing position NPP, where it performs maintenance of the nozzle heads in the nozzle unit 10U, as shown in FIG. 7D.

The cleaning mechanism 90 shown in FIG. 1 has a washing board 91. The washing board 91 is supported by a rotating mechanism 95 to be movable about the rotating shaft of the drum 5 between the standby position shown in FIG. 7A and the cleaning position shown in FIGS. 7C and 7D.

Figure 7C:
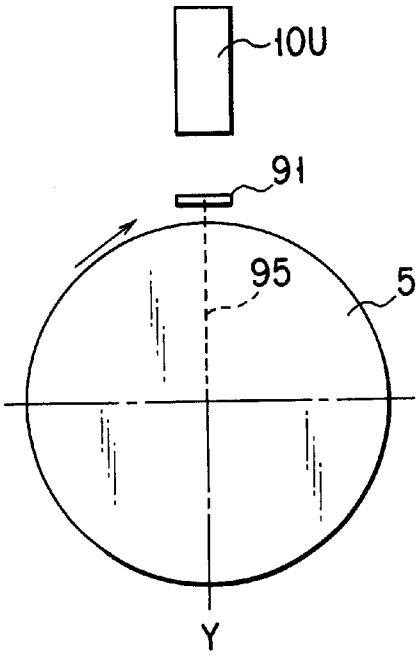
Figure 7D:
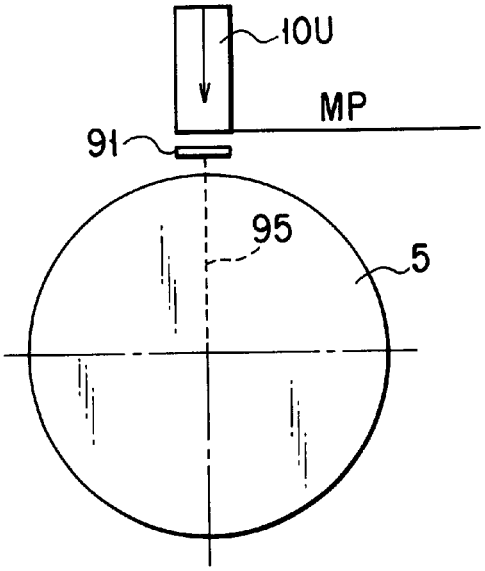

When performing maintenance, the nozzle unit 10U is moved to the non-printing position NPP shown in FIG. 7A, and the washing board 91 is pivoted by the rotating mechanism 95 from the standby position shown in FIG. 7A to the cleaning position shown in FIG. 7C, and is positioned between the drum 5 and nozzle unit 10U. After that, the nozzle unit 10U is moved downward by the elevating mechanism 40 to the maintenance position MP, as shown in FIG. 7D, to be adjacent to and oppose the washing board 91.

In this state, inks are discharged from the respective nozzle heads 10C, 10Y, 10M, and 10B of the nozzle unit 10U to remove any clogging of the nozzle heads. At this time, the washing board 91 receives the inks discharged from the respective nozzle heads and delivers them to, e.g., a waste ink bottle. Furthermore, an ink flow layer is formed between the washing board 91 and the distal end surfaces of the respective nozzle heads by utilizing the inks which are being discharged, so any paper dust attaching to the distal end surfaces of the respective nozzle heads can be removed.

After the maintenance is ended, the nozzle unit 10U is moved upward to the non-printing position NPP by the elevating mechanism 40, and the washing board 91 is returned to the standby position by the rotating mechanism 95.

According to the ink-jet printer having the above arrangement, during printing, the sheet P fed from the feeder 81 is wound on the circumferential surface of the drum 5 by the convey mechanism 82 and is held there. Simultaneously, ink is supplied from the ink feed mechanism 88 to the respective nozzle heads 10C, 10Y, 10M, and 10B of the nozzle unit 10U. The nozzle unit 10U is then moved from the non-printing position to the printing position PP by the elevating mechanism 40. When the nozzle unit 10U moves downward to the printing position, it is supported there by the three-point support mechanism 20. More specifically, the movable supports 21N and 31N provided on the nozzle unit 10U are supported on the corresponding stationary supports 21P and 31P. Simultaneously, the nozzle unit 10U and the carrier 48 of the elevating mechanism 40 disengage from each other. The carrier 48 moves downward to the disengaging position, and the nozzle unit 10U is supported at the printing position by the three-point support mechanism 20 to be free from the carrier 48. At the printing position, the distal ends of the nozzle heads 10C, 10Y, 10M, and 10B of the nozzle unit 10U oppose the printing surface of the sheet P wound on the circumferential surface of the drum 5 at a gap of about 1 mm.

In this state, selected ink-jet nozzles 9 of the nozzle heads 10C, 10Y, 10M, and 10B discharge inks onto the sheet P. While the nozzle unit 10U is moved forward by the reciprocating mechanism 60 in the main scanning direction X by a predetermined distance (e.g., a distance corresponding to the pitches of the ink-jet nozzles) to perform line printing, column printing is performed in the subscanning direction R by utilizing rotation of the drum 5. Hence, for example, an A4 sheet P can be printed in color at a high speed of 20 RPM. The printed sheet P is delivered by the convey mechanism 82 onto the delivery tray 12.

When printing is ended, the carrier 48 of the elevating mechanism 40 is moved upward from the disengaging position. The support arms 47 engage with the engaging pins 11P and 12P of the nozzle unit 10U with a time lag corresponding to the distance between the engaging pins 11P and 12P, to support the nozzle unit 10U. After that, the carrier 48 is moved upward so that the nozzle unit 10U moves upward from the printing position to the non-printing position NPP or maintenance position MP, and is held there.

According to the ink-jet printer having the above arrangement, when the nozzle unit 10U is at the printing position, it is disconnected, i.e., disengaged, from the elevating mechanism 40, and is supported with respect to the elevating mechanism 40 by its own weight. Since vibration produced by the nozzle heads 10C, 10Y, 10M, and 10B during printing is not transmitted to the elevating mechanism 40, the nozzle unit 10U is prevented from being displaced by the vibration of the elevating mechanism 40. As a result, the nozzle unit 10U can be supported at the printing position stably, and the elevating mechanism itself need not strictly prevent vibration, so the arrangement of the elevating mechanism can be simplified and the cost of the elevating mechanism can be reduced.

When the nozzle unit 10U is at the printing position, it is supported on the housing 1 as the stationary side by the three-point support mechanism 20, to regulate its Y-axis position, i.e., the gap between the respective nozzle heads and the printing surface. Since the movable supports 21N and 31N of the three-point support mechanism 20 are mounted on the brackets 8 of the housing 1, they can be easily set at predetermined positions precisely with respect to the drum 5. Therefore, the gap between the respective nozzle heads and the printing surface can be established at a predetermined value (e.g., 1 mm) quickly and precisely by supporting the nozzle unit 10U with the three-point support mechanism 20.

Since the three-point support mechanism 20 can hold constant the nozzle heads and the printing surface not only in the Y-axis direction perpendicular to the printing surface but also three-dimensionally relative to each other, it can also hold the nozzle heads in predetermined postures in the main scanning direction X. Therefore, the gap between the nozzle heads and the printing surface can be established quickly and precisely, and the established gap can be maintained reliably and stably.

Of the three-point support mechanism 20, only three sets of stationary and movable supports need be disposed at predetermined positions relative to each other. Also, the stationary and movable supports of each set have the same structure as that of other sets. Hence, the structure can be simplified and the cost can be reduced.

The three-point support mechanism 20 supports the nozzle unit 10U to be movable in the main scanning direction X. Consequently, while the gap between the nozzle heads and the printing surface is maintained at the predetermined value, the nozzle unit 10U can be reciprocally moved by the reciprocating mechanism 60 in the main scanning direction X, enabling printing having a high image quality.

Since the stationary supports 21P and 31P of each set have bearing structures (22, 23, 24, 32, 33, and 34) that can be displaced relative to each other in the main scanning direction X, the resistance against relative displacement in the X direction can be minimized. The reciprocal movement of the nozzle unit 10U in the main scanning direction X can be performed smoothly, and down sizing and power consumption reduction of the reciprocating mechanism 60 can be promoted. Simultaneously, since the reciprocating mechanism 60 is partly constituted by the springs 25 and 35 that bias the cylinders 23 and 33 of the stationary supports toward the home position, the nozzle unit 10U can be reciprocally moved quickly, and the printing speed can be further increased.

In the embodiment described above, of the engaging mechanism 50, the first engaging portion of the nozzle unit 10U side is constituted by the engaging pins 11P and 12P, and the second engaging portion of the carrier 48 side is constituted by the support end faces and engaging holes. However, the first engaging portion may be engaging holes, and the second engaging portion engaging pins.

The second embodiment of the present invention will be described.

An ink-jet printer according to the second embodiment has an elevating guide mechanism in addition to an arrangement identical to that of the ink-jet printer described above. While an elevating mechanism 40 drives a nozzle unit 10U to move it vertically, the elevating guide mechanism regulates the nozzle unit 10U at a predetermined position in the main scanning direction and at a predetermined position in the subscanning direction. When the nozzle unit 10U moves to the printing position, the elevating guide mechanism cancels its guide function. Other than this, the arrangement of the second embodiment is the same as that of the first embodiment. The same portions in the second embodiment as in the first embodiment are denoted by the same reference numerals, and a detailed description thereof will be omitted.

The elevating guide mechanism guides the vertical movement of the nozzle unit 10U while regulating the positions of the nozzle unit 10U in the main scanning and subscanning directions. In the second embodiment, the elevating guide mechanism has a two-block structure.

Figure 8:
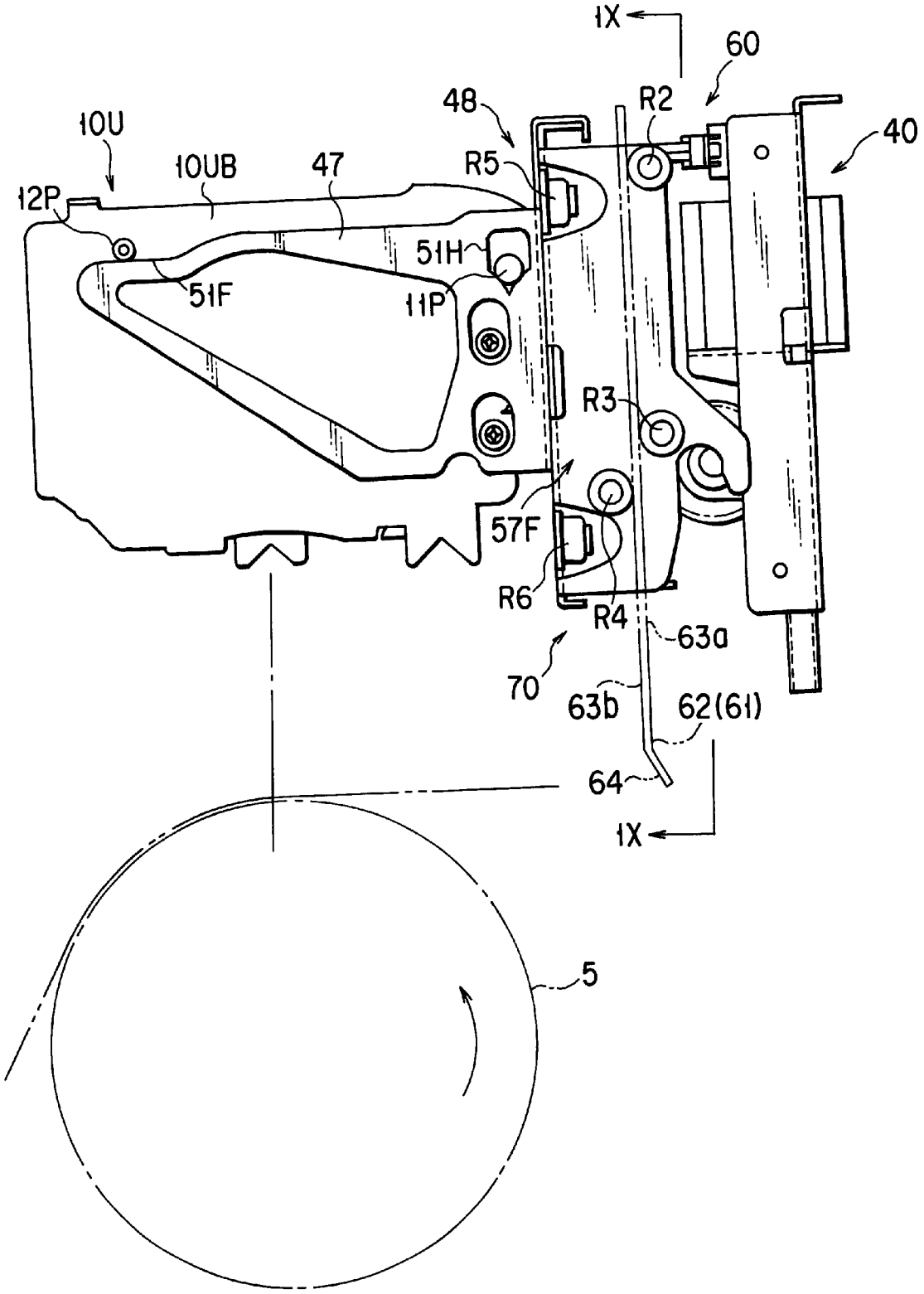
Figure 9:
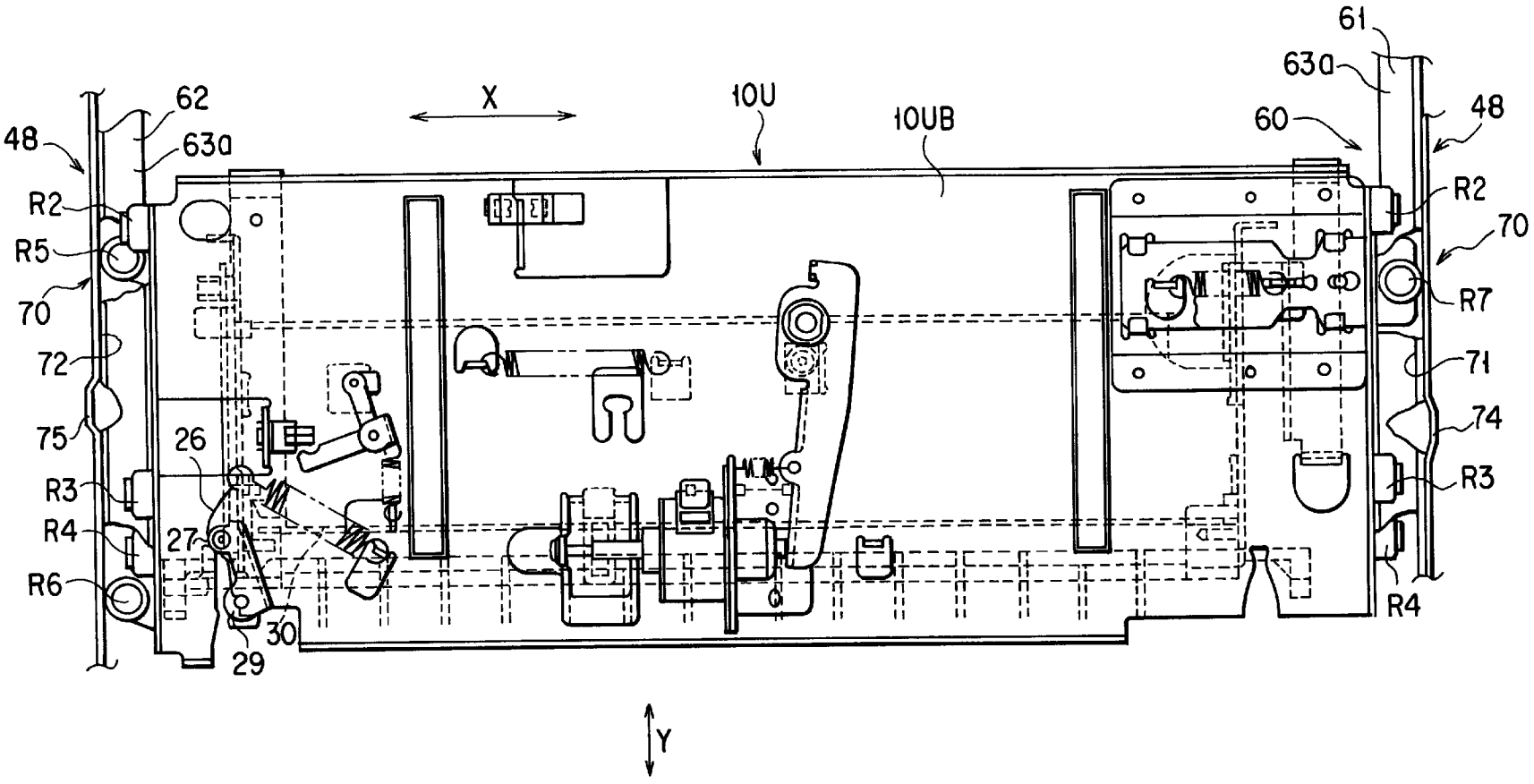

More specifically, as shown in FIGS. 8 and 9, the elevating guide mechanism has a first guide mechanism 60 and a second guide mechanism 70. The first guide mechanism 60 regulates the position of the nozzle unit 10U in the subscanning direction while the nozzle unit 10U moves vertically. The second guide mechanism 70 regulates the position of the nozzle unit 10U in the main scanning direction with respect to a carrier 48.

The first guide mechanism 60 has a pair of right and left guide rails 61 and 62 fixed to the housing and extending in an elevating direction Y, and a plurality of guide rollers provided to a unit main body 10UB of the nozzle unit 10U. The guide rails 61 and 62 are separated from each other in the main scanning direction X and are arranged on two sides of the nozzle unit 10U. Each of the guide rails 61 and 62 has guide surfaces 63*a* and 63*b* extending in parallel to the main scanning direction X.

Three guide rollers are provided to each of the two ends of the unit main body 10UB in the main scanning direction to build a three-point roller guide. More specifically, each three-point roller guide has guide rollers R2, R3, and R4 rotatable about an axis parallel to the main scanning direction X. The guide rollers R2 and R3 of each three-point roller guide are spaced apart from each other in the Y direction, and are in rolling contact with the guide surface 63*a* on the lower side of the corresponding guide rail 61 or 62. The guide roller R4 is located underneath the guide roller R3 in the Y direction and is in rolling contact with the guide surface 63*b* on the upper side of the corresponding guide rail 61 or 62. Lower ends 64 of the guide rails 61 and 62 are bent in a direction away from the nozzle unit 10U.

The second guide mechanism 70 has a pair of right and left guide surfaces 71 and 72 formed on the inner surfaces of the carrier 48 and extending in the elevating direction Y, and three guide rollers R5, R6, and R7 provided to the unit main body 10UB. The guide surfaces 71 and 72 are spaced apart from each other in the main scanning direction X, and are located on two sides of the nozzle unit 10U and within horizontal planes perpendicular to the main scanning direction.

The guide rollers R5, R6, and R7 are rotatable about axes each extending in a direction perpendicular to the main scanning direction X. The two guide rollers R5 and R6 are provided on one end side in the main scanning direction of the unit main body 10UB and are in rolling contact with the guide surface 72 from the inner side. The remaining guide roller R7 is provided on the other end side in the main scanning direction of the unit main body 10UB and is in rolling contact with the guide surface 71 from the inner side. Hence, the guide rollers R5, R6, and R7 construct a three-point roller guide.

That portion of the guide surface 71, which opposes the guide roller R7 when the nozzle unit 10U moves to the printing position forms an outwardly swelling recess 74. Similarly, those portions of the guide surface 72, which oppose the guide rollers R5 and R7 respectively when the nozzle unit 10U moves to the printing position form outwardly swelling recesses 75 and 76.

According to the elevating guide mechanism having the above arrangement, while the nozzle unit 10U moves between the non-printing position and the printing position below it shown in FIGS. 8 and 9, the guide rollers R2 and R3 of the first guide mechanism 60 roll on the guide surfaces 63*a* of the guide rails 61 and 62, while the guide rollers R4 rotate on the guide surfaces 63*b* of the guide rails 61 and 62. As a result, the nozzle unit 10U moves vertically while its position is regulated at a predetermined position in the subscanning direction, i.e., in a direction perpendicular to the main scanning direction X in the horizontal plane.

While the nozzle unit 10U moves vertically between the non-printing position and the printing position below it, the guide rollers R5 and R6 of the second guide mechanism 70 are in contact with the guide surface 72 of the carrier 48, while the guide roller R7 is in contact with the guide surface 71. As a result, the nozzle unit 10U moves vertically while its position is regulated at a predetermined position in the main scanning direction X by the second guide mechanism 70.

Figure 10:
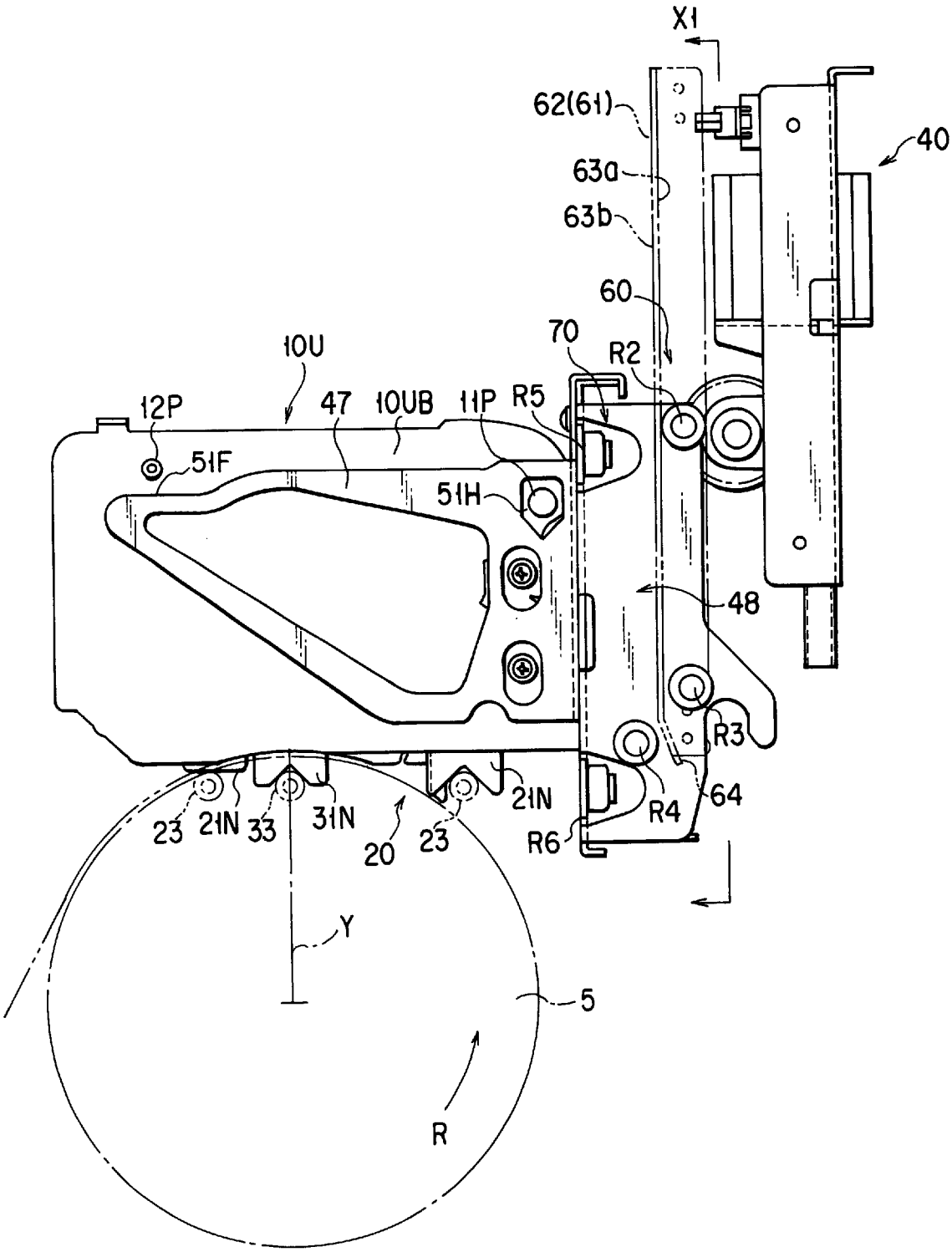
Figure 11:
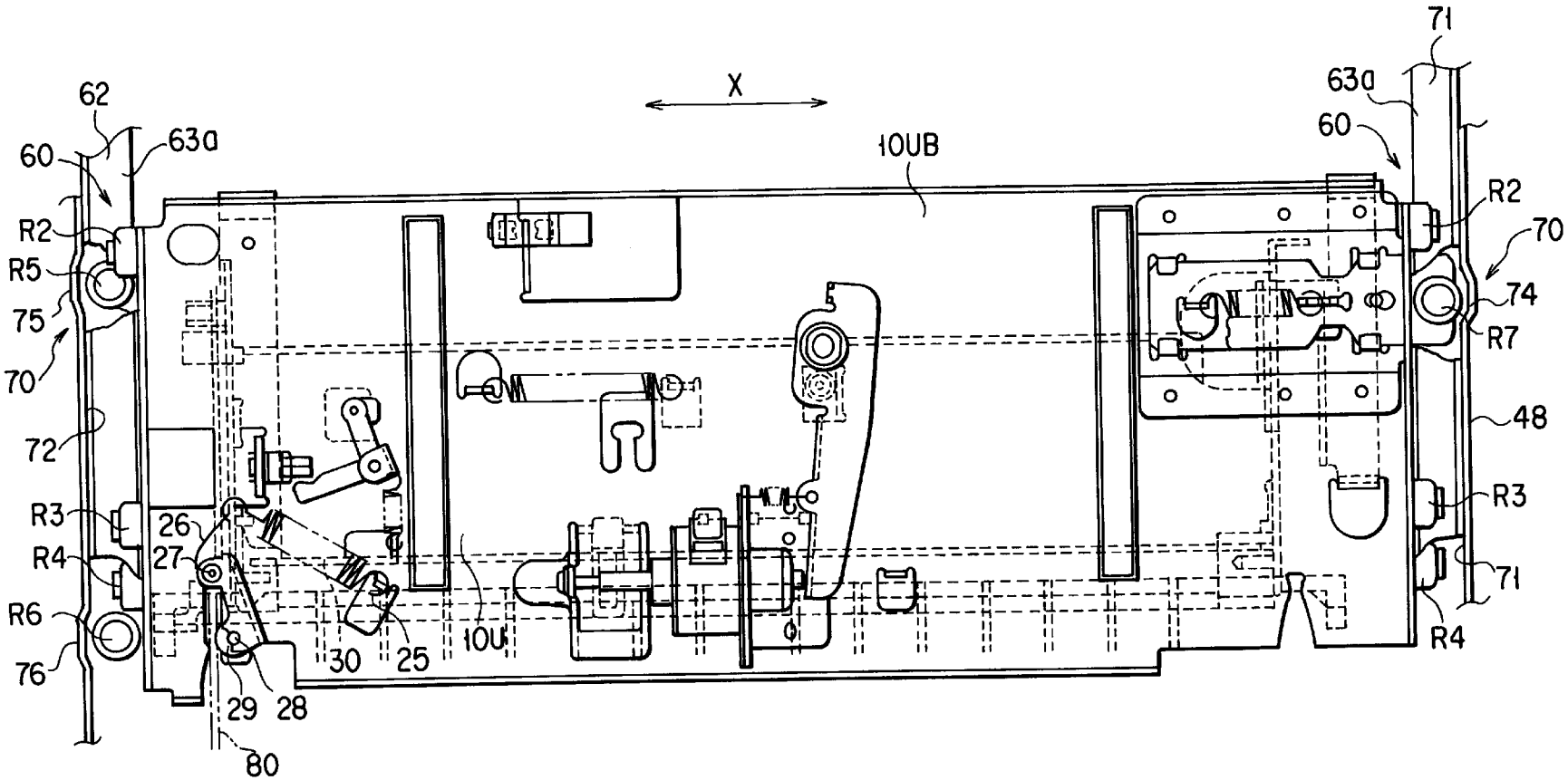

As shown in FIGS. 10 and 11, when the nozzle unit 10U moves downward to the printing position and is supported by the three-point support mechanism 20, and the carrier 48 moves downward to the disengaging position, the carrier 48 and nozzle unit 10U disengage from each other, in the same manner as in the first embodiment described above. Similarly, according to the second embodiment, the guide rollers R4 of the first guide mechanism 60 are located to oppose the lower ends 64 of the guide rails 61 and 62, and are separated from the guide surfaces 63*b*. Hence, the position regulation for the nozzle unit 10U by the first guide mechanism 60 is canceled, so that the nozzle unit 10U can swing about the contact point between the guide rollers R2 and the guide surfaces 63*a* as a fulcrum. Accordingly, the nozzle unit 10U can be displaced in the subscanning direction. In this state, all the guide rollers R2, R3, and R4 may not come into contact with the corresponding guide surfaces 63*a* and 63*b*.

The guide rollers R5, R6, and R7 of the second guide mechanism 70 are located to oppose the recesses 75 and 76 formed in the guide surface 72 and the recess 74 formed in the guide surface 71, respectively, and are separated from the guide surfaces 72 and 71. Hence, position regulation for the nozzle unit 10U in the main scanning direction by the second guide mechanism 70 is canceled, and the nozzle unit 10U can be displaced in the main scanning direction X while it is supported by the three-point support mechanism 20.

As shown in FIG. 9, a switching lever 26 is attached to the lower portion on the rear side of the unit main body 10UB of the nozzle unit 10U. The switching lever 26 can pivot about a support shaft 27 perpendicular to the main scanning direction X. A press roller 29 rotatable about a support shaft 28 is attached to one end of the switching lever 26, and a tension spring 30 extends between the other end of the switching lever 26 and the unit main body 10UB. The switching lever 26 is biased clockwise in FIG. 9 by the tension spring 30.

As shown in FIG. 11, a stationary positioning plate 80 is provided on the housing side of the printer and extends in a direction perpendicular to the main scanning direction X. The positioning plate 80 can abut against the press roller 29 of the switching lever 26. When the nozzle unit 10U moves downward to the printing position, the press roller 29 of the switching lever 26 abuts against the positioning plate 80. The nozzle unit 10U is biased in the main scanning direction X by the functions of the spring 25 and tension spring 30, so that it is elastically positioned at a predetermined position in the main scanning direction.

With the ink-jet printer according to the second embodiment having the above arrangement, the nozzle unit 10U is regulated in its position in the subscanning and main scanning directions between the non-printing and printing positions by the first and second guide mechanisms 60 and 70, and moves vertically when it is stably positioned at the predetermined positions. When the nozzle unit 10U moves to the printing position and is supported by the three-point support mechanism 20, position regulation for the nozzle unit 10U by the first and second guide mechanisms 60 and 70 is canceled, and simultaneously the nozzle unit 10U and carrier 48 disengage from each other. Hence, the nozzle unit 10U is supported at the printing position by the three-point support mechanism 20 while it is allowed to move in the main scanning direction X. In this state, the nozzle unit 10U is biased in the main scanning direction X by the switching lever 26, and comes into contact with the stationary positioning plate 80 to be elastically positioned by it.

More specifically, the nozzle unit 10U is disconnected from the elevating mechanism 40 and the elevating guide mechanism in the main scanning direction X, and is regulated in position in the main scanning direction by the positioning plate 80 that can absorb vibration. Accordingly, vibration in the main scanning direction and subscanning direction is not transmitted from the elevating mechanism 40 to the nozzle unit 10U including the nozzle heads 10C, 10Y, 10M, and 10B held at the printing position by the three-point support mechanism 20. When ink is discharged from the nozzle head toward the printing surface, precise printing free from positional errors in the main scanning direction and the subscanning direction can be performed.

The positioning plate 80 may be stationarily disposed at a predetermined position of the housing, or may move to a predetermined position when the nozzle unit 10U moves downward to the printing position.

In the first guide mechanism 60, the lower ends 64 of the guide surfaces 71 and 72 are bent outward. When the nozzle unit 10U moves to the printing position, the guide rollers and the guide rails do not come into contact with each other. In the second guide mechanism 70, the recesses 74, 75, and 76 are formed in the guide surfaces 71 and 72. When the nozzle unit 10U moves to the printing position, the guide rollers and the guide surface do not come into contact with each other. Therefore, position regulating/regulation canceling function for the nozzle unit 10U in the main scanning direction and the subscanning direction by the elevating guide mechanism can be realized with a simple structure and at a low cost.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet printer comprising:

a medium holding member for holding a printing medium;

a nozzle unit having a plurality of nozzle heads, each of the plurality of nozzle heads having a large number of ink-jet nozzles aligned in a main scanning direction;

an elevating mechanism for vertically moving the nozzle unit between a printing position where the plurality of nozzle heads oppose a printing surface of the printing medium held by the medium holding member to print on the printing surface with the plurality of nozzle heads, and a non-printing position above the printing position which is separate from the printing position;

a head support mechanism for supporting the nozzle unit which has moved to the printing position, and an engaging mechanism for causing the elevating mechanism and the nozzle unit to engage each other to allow the nozzle unit to be vertically moved by the elevating mechanism when the nozzle unit is between the printing position and the non-printing position, and to disengage from each other by the head support mechanism so as to set the nozzle unit to be free from the elevating mechanism when the nozzle is located at the printing position.

2. A printer according to claim 1, wherein the elevating mechanism has a carrier vertically movable among the non-printing position, the printing position, and a disengaging position below the printing position, and the engaging mechanism has a first engaging portion provided at the nozzle unit and a second engaging portion provided at the carrier, the second engaging portion serving to engage with the first engaging portion, when the carrier moves between the non-printing and printing positions, to support the nozzle unit, and to disengage from the first engaging portion while the carrier moves between the printing and disengaging positions.

3. A printer according to claim 2, wherein the carrier has a pair of arms spaced apart from each other in the main scanning direction and located on two sides of the nozzle unit, the nozzle unit has a pair of end portions spaced apart from each other in the main scanning direction and opposing the arms, respectively, and the first engaging portion has a pair of engaging pins projecting from each of the end portions of the nozzle unit, and the second engaging portion has a support end edge formed in each of the arms and located under a corresponding one of the engaging pins to overlap therewith, and an engaging hole through which a corresponding one of the engaging pins is inserted loosely.

4. A printer according to claim 1, wherein the head support mechanism has a plurality of stationary supports arranged stationarily with respect to an elevating direction of the nozzle unit, and a plurality of movable supports provided on the nozzle unit and supported on the stationary supports at the printing position.

5. A printer according to claim 4, wherein the head support mechanism includes a three-point support mechanism for supporting the nozzle unit to be movable in the main scanning direction, the three-point support mechanism having two of the stationary supports, which are provided on one side of the printing surface in the main scanning direction, one of the stationary support, which is provided on the other side of the printing surface, two of the movable supports, which are provided on one of the end portions of the nozzle unit in the main scanning direction, and one of the movable supports, which is provided on the other end portion of the nozzle unit.

6. A printer according to claim 5, wherein each of the stationary supports has a stationary shaft extending in the main scanning direction, and a cylindrical member which is supported on the support shaft to be movable in the main scanning direction and on which the corresponding movable support is adapted to be placed.

7. A printer according to claim 1, which further comprises an elevating guide mechanism which regulates movement of the nozzle unit in the main scanning direction and a subscanning direction when the nozzle unit is vertically moved between the non-printing position and the printing position by the elevating mechanism, and which cancels movement regulation in the main scanning direction and the subscanning direction when the nozzle unit is located at the printing position and is supported by the head support mechanism.

8. A printer according to claim 7, wherein the elevating guide mechanism comprises a first guide mechanism for regulating movement of the nozzle unit in the subscanning direction, the first guide mechanism having a guide rail extending in an elevating direction of the nozzle unit, and a guide roller provided on the nozzle unit and being in rolling contact with a guide surface of the guide rail, and the guide rail has a bent portion which separates from the guide roller to cancel movement regulation for the nozzle unit in the subscanning direction when the nozzle unit moves to the printing position.

9. A printer according to claim 7, wherein the elevating guide mechanism comprises a second guide mechanism for regulating the movement of the nozzle unit in the main scanning direction, the second guide mechanism having a guide surface extending in an elevating direction of the nozzle unit, and a guide roller provided on the nozzle unit and being in rolling contact with the guide surface, and the guide surface of the second guide mechanism has a recess which separates from the guide roller to cancel movement regulation for the nozzle unit in the main scanning direction when the nozzle unit is located at the printing position.

10. An ink-jet printer comprising:

a medium holding member for holding a printing medium;

a nozzle unit having a plurality of nozzle heads aligned in a subscanning direction, each of the plurality of nozzle heads having a large number of ink-jet nozzles aligned in a main scanning direction perpendicular to the subscanning direction;

an elevating mechanism for vertically moving the nozzle unit between a printing position where the plurality of nozzle heads oppose a printing surface of the printing medium held by the medium holding member to print on the printing surface, and a non-printing position above the printing position which is separate from the printing position, where maintenance of the plurality of nozzle heads is performed;

a head support mechanism for supporting the nozzle unit, which has moved to the printing position, to be movable in the main scanning direction; and an elevating guide mechanism which regulates movement of the nozzle unit in the maul scanning direction and the subscanning direction while the nozzle unit is vertically moved by the elevating mechanism between the non-printing position and the printing position, and which cancels movement regulation in the main scanning direction by the head support mechanism when the nozzle unit is moved to the printing position and is supported by the head support mechanism.

11. An ink-jet printer comprising:

a medium holding member for holding a printing medium;

a nozzle unit having a plurality of nozzle heads aligned in a subscanning direction, each of the plurality of nozzle heads having a large number of ink-jet nozzle aligned in a main scanning direction perpendicular to the subscanning direction;

an elevating mechanism for vertically moving the nozzle unit between a printing position where the nozzle heads oppose a printing surface of the printing medium held by the medium holding member to print on the printing surface, and a non-printing position above the printing position which is separate from the printing position, where maintenance of the plurality of nozzle heads is performed;

a head support mechanism for supporting the nozzle unit, which has moved to the printing position, to be movable in the main scanning direction while regulating movement of the nozzle unit in the subscanning direction; and an elevating guide mechanism which regulates movement of the nozzle unit in the main scanning direction and the subscanning direction while the nozzle unit is vertically moved by the elevating mechanism between the non-printing position and the printing position, and which cancels movement regulation of the nozzle unit in the main scanning direction and the subscanning direction by the head support mechanism when the nozzle unit is moved to the printing position and is supported by the head support mechanism.

12. A printer according to claim 11, wherein the elevating guide mechanism comprises a first guide mechanism having a guide rail and a guide roller to regulate movement of the nozzle unit in the subscanning direction, the guide rail extending in an elevating direction of the nozzle unit, and the guide roller being provided on the nozzle unit to be in rolling contact with a guide surface of the guide rail, and the guide rail has a bent portion which separates from the guide roller to cancel movement regulation for the nozzle unit in the subscanning direction when the nozzle unit is moved to the printing position.

13. A printer according to claim 12, wherein the elevating guide mechanism comprises a second guide mechanism for regulating the movement of the nozzle unit in the main scanning direction, the second guide mechanism having a guide surface extending in an elevating direction of the nozzle unit, and a guide roller provided on the nozzle unit and being in rolling contact with the guide surface, and the guide surface of the second guide mechanism has a recess which separates from the guide roller to cancel movement regulation for the nozzle unit in the main scanning direction when the nozzle unit is located at the printing position.

14. A printer according to claim 12, which further comprises a positioning member stationarily arranged near the nozzle unit which has moved to the printing position, and a switching member provided on the nozzle unit so as to abut against the positioning member to elastically position the nozzle unit at a predetermined position in the main scanning direction when the nozzle unit has moved to the printing position.

15. A printer according to claim 14, wherein the switching member has a switching lever pivotally mounted on the nozzle unit, a rotatable roller rotatably attached to the switching lever, and a biasing member extending between the switching member and the nozzle unit to elastically press the rotatable roller against the positioning member.

* * * * *